US008596717B2

(12) United States Patent
Glyck

(10) Patent No.: US 8,596,717 B2
(45) Date of Patent: Dec. 3, 2013

(54) POSTURE TRAINER

(76) Inventor: Gordon Glyck, Montville, NJ (US)

( * ) Notice: Subject to any disclaimer, the term of this patent is extended or adjusted under 35 U.S.C. 154(b) by 0 days.

(21) Appl. No.: 13/236,874

(22) Filed: Sep. 20, 2011

(65) Prior Publication Data

US 2012/0112506 A1 May 10, 2012

Related U.S. Application Data

(63) Continuation-in-part of application No. 12/586,972, filed on Sep. 30, 2009, now abandoned.

(60) Provisional application No. 61/101,174, filed on Sep. 30, 2008.

(51) Int. Cl.
*A47C 7/02* (2006.01)

(52) U.S. Cl.
USPC ..... 297/230.1

(58) Field of Classification Search
USPC ..... 297/452.41, 230.1, 230.13, 230.14, 297/DIG. 3; 5/655.3, 654, 652, 653, 630, 5/648
See application file for complete search history.

(56) References Cited

U.S. PATENT DOCUMENTS 1,721,571 A * 7/1929 Miller ..... 4/575.1
3,348,880 A 10/1967 Swann
3,361,471 A 1/1968 Radford
3,503,084 A * 3/1970 Meinwieser ..... 5/630
4,108,492 A 8/1978 Kirby
4,132,228 A 1/1979 Green
4,471,993 A 9/1984 Watson
4,516,568 A 5/1985 Baxter
4,535,495 A 8/1985 Oldfield
4,572,578 A * 2/1986 Perkins ..... 297/452.32
4,709,431 A 12/1987 Shaktman
4,718,724 A 1/1988 Quinton
4,835,801 A 6/1989 Walpin
4,864,668 A 9/1989 Crisp
4,876,755 A 10/1989 Parrish
5,216,771 A * 6/1993 Hoff ..... 5/648
5,314,235 A * 5/1994 Johnson ..... 297/284.5
5,389,064 A 2/1995 Cohen
5,551,752 A 9/1996 Lovegrove
5,634,223 A * 6/1997 Obermaier ..... 5/654
D380,835 S 7/1997 Peddy
5,660,438 A 8/1997 Tedesco
D383,628 S * 9/1997 Shamir ..... D6/502
5,685,613 A 11/1997 Franzen, Jr.
5,722,725 A 3/1998 McNaughton
5,769,490 A 6/1998 Falzon
5,868,463 A 2/1999 MacKenzie et al.

(Continued)

*Primary Examiner* — Milton Nelson, Jr.
(74) *Attorney, Agent, or Firm* — Thomas A. O'Rourke; Bodner & O'Rourke, LLP

(57) ABSTRACT

A posture trainer properly supports the upper thoracic spine in relation to the lumbar region. The trainer's front surface transitions into a back surface at a periphery, forming a fluid-filled cavity. The back surface contacts a chair back; the periphery's base contacts the seat, and the front surface selectively contacts the seated person's back. A bottom portion has a first thickness between the front and back surfaces. A top portion has a bulging central region forming a second thickness between its peak and the back surface, being greater than the first thickness. The bulge position initially focuses pressure on, and supports, a portion of the thoracic spine in proper relation to the lumbar spinal region using the first and second thicknesses. Compression of the flexible thermoplastic causes bulge deformation to mold the trainer central portion to also provide spinal support between the lumbar and upper thoracic spinal regions.

23 Claims, 8 Drawing Sheets

(56) References Cited

U.S. PATENT DOCUMENTS

| | | | | |
|---|---|---|---|---|
| 6,132,004 | A | 10/2000 | Carlino | |
| 6,299,248 | B1 | 10/2001 | Gennaro | |
| 6,668,405 | B1 | 12/2003 | Kohlman | |
| 6,969,114 | B2 | 11/2005 | Keilhauer | |
| 7,114,776 | B1 | 10/2006 | Wiltberger | |
| 7,703,849 | B2 | 4/2010 | Bilak et al. | |
| 2005/0028284 | A1 | 2/2005 | Gartrell | |
| 2006/0255646 | A1 | 11/2006 | Davis | |
| 2009/0309399 | A1* | 12/2009 | Liu | 297/230.1 |

* cited by examiner

Normal spine

Side view of spine

POSTURE TRAINER

CLAIM OF PRIORITY

This application is a continuation-in-part of U.S. application Ser. No. 12/586,972 filed Sep. 30, 2009, now abandoned which claims priority to U.S. Ser. No. 61/101,174 filed Sep. 30, 2008, the contents of which are fully incorporated herein by reference.

FIELD OF THE INVENTION

The invention relates to therapeutic supports, in particular, spinal supports. More particularly, the present invention relates to a therapeutic posture support that provides support for a user's back and helps correct poor posture particularly when a user is seated.

BACKGROUND OF THE INVENTION

Millions of Americans suffer from back problems and associated pain. Often back pain originates with improper posture of the thoracic spine. The invention of the present application trains the user to properly align the thoracic area of the spine.

"Normal spinal posture helps reduce potential strain. Unfortunately, our modern lifestyles in concert with the forces of gravity conspire to ruin our healthy upright posture. The elderly are often slumped because of bad posture or sometimes from osteoporosis. This habit of slumping begins in childhood, when we sit in front of televisions, sit in school, sit in cars, etc. Sitting and inactivity invite poor posture, thus over-straining our spinal muscles, ligaments and joints." (1). When parents tell their children to "Sit up straight!" they are usually doing so because poor posture looks bad. Poor posture can be recognized by the following: rounded shoulders, head leaning forward, protruding abdomen, locked knees, hands facing backwards while standing, feet turned out. What most parents who've said "Sit up straight" don't realize is that the following ailments are typical results of poor posture: neck pain, headaches, upper back/shoulder pain, jaw pain, low back pain, arthritis and shallow breathing--all resulting in fatigue. Additionally, J. T. Freeman found that as people aged, poor posture resulted in intestinal problems, hemorrhoids, varicose veins, osteoporosis, hip and foot deformities, poor health, decreased quality of life and a shortened life span. (2) In reading this, one can understand the life-long ramifications of poor posture.

There are 3 regions of the spine; the cervical region, more commonly referred to as the neck, is composed of 7 vertebra and their discs and has a forward curvature, known as the lordotic curve. The thoracic spine is the midback, which is composed of 12 vertebra and their discs and its shape is known as a kyphotic curve. The lumbar spine, known as the low back and is composed of 5 vertebra and their discs. Its shape is also lordotic. There is a natural center of gravity, which falls through these curves. When posture is thrown off, the center of gravity is thrown off as well and excess strain is placed on the spine and spinal muscles. Excess strain has many effects on the body, but the one that people will notice most is discomfort and, eventually, pain.

Let's face it: modern life requires us to do a lot of sitting. One of the leading causes, if not the leading cause of poor posture is a result of the way we sit. Improper sitting leads to excess rounding of the thoracic spine, known as hyperkyphosis. This contributes to excess force placed on the intervertebral discs of the lumbar spine.

Unfortunately, when it comes to supporting the spine, the longest segment of the spine, the thoracic spine, has been the most overlooked—until now. Most back supports only work to support the lumbar spine and fail to address the thoracic spine and the transitional area between the two, known as the thoracolumbar region. The posture trainer is the first device designed to support the thoracic spine and thoracolumbar region. The posture trainer allows a person to experience the feel of, and maintain, proper posture in the seated position. Once we learn correct seated posture and can maintain it, poor posture will become uncomfortable.

This simple, yet revolutionary device will change ergonomics in the home as well as the workplace. When the spine is not supported, there is a tremendous amount of energy wasted in trying to maintain physical comfort. For many people, this can become quite a struggle leading to pain and fatigue. By using the posture trainer people will experience an increase in energy, as they will no longer be in a constant struggle to get comfortable. This will go a long way in increasing productivity in the workplace. As children spend more and more time seated at computers and in school, they will be able to sit more comfortably for longer periods of time. Proper postural training now will enable their bodies to grow and develop correctly, due to maintaining normal postural forces while they sit. This will also result in a decreased incidence of parents telling their children to "Sit up straight!!"

DESCRIPTION OF THE PRIOR ART

U.S. Pat. No. D380,835 teaches an orthopedic pillow for use in an automobile.

U.S. Pat. No. 7,114,776 teaches a lumbar support cushion consists of a seat portion and a back portion, foldably joined along a crease positioned there between. An opening extends in a continuous manner upward into the back portion, and downward into the seat portion. The opening may have an oval shape. In one embodiment, a support member is provided, and is positioned across the front of the back portion. The position of the support member along the back portion may be made adjustable, for example by the use of mating hook and loop material on the support member and a rear portion of the back portion.

U.S. Pat. No. 6,969,114 teaches a support device for use in supporting a user's spine while in a seated position, including lower, top and intermediate sections merged smoothly in a rigid piece. The device extends the entire length of the user's spine from occipital region to coccyx, and includes lateral support for maintaining a centered spinal position. The device preferably sits on the seat of a chair or automobile seat and leans against the back of the seat to support the user's spine. The intermediate section of the device is preferably narrow to sit flush with the user's back between the shoulder blades (scapulae) and allowing the user to rotate to either side in the seat. The support is preferably constructed with a flocked or fabric-covered foam exterior over a rigid plastic armature.

U.S. Pat. No. 6,668,405 teaches a cushion having a plurality of inflatable and deflatable cells useful for periodically shifting the points of contact between the cushion and a body supported by the cushion in order to reduce or eliminate the development of pressure sores. The cushion includes one or more of (i) at least two encircling cells shaped so as to define a central concavity in the upper surface of each of the encircling cells, (ii) at least one repositionable cell, (iii) at least two cells having contoured upper surfaces which define a longitudinally extending laterally concave channel, and (iv) two groupings of independently inflatable and deflatable cells arranged asymmetrically about a longitudinal axis. U.S. Pat. No. 6,299,248 teaches a posture system with a lumbar pad and a cervical pad either one or both of which may be used. The lumbar and cervical pads may be supported on a chair by arms which can be bent to a desired position which position is retained until sufficient force is applied to place the arms into a different position. A back cover held on the back of a chair by a pocket at the end of back cover may also used with or be used in place of the arms. Hook and loop material on the lumbar pad and the cervical pad and the back cover provides support for the lumbar pad and the cervical pad. The lumbar pad and the cervical pad wrap up into the back cover which is held in the pocket for carrying.

U.S. Pat. No. 5,769,490 teaches an adjustable lumbar support of the kind including a flexible band which in use extends transverse of a seat backrest. The lumbar support has means for adjusting the rearward curvature of the band in a fore and aft direction and also has means for adjusting the relative effective lengths of the upper and lower regions of the band. An intermediate portion of the band is made up of a number of interconnected segments, and the location of the connection between adjacent segments may alternate between the upper and lower regions of the band. A flexible frame is connected to the band to support the band and associated components such as the adjusting means actuators, in a configuration such as to permit convenient attachment of the band assembly to a seat backrest. The frame can also function as biasing means such as to bias the band towards a condition of minimum rearward curvature.

U.S. Pat. No. 5,722,725 teaches a lumbar support has a pair of laterally spaced cushions with a strap extending between them. The lateral spacing of the cushions may be adjusted by varying the length of the strap. The cushions are supported on the chair back by a pair of hooks that locate the cushions vertically.

U.S. Pat. No. 5,685,613 teaches an orthopedic pillow for helping to correct and helping to prevent hyperkyphosis and rigidity of the thoracic spine and for returning the normal lordotic cervical curve comprises a base panel having a first end portion, a second end portion, a left top surface segment extending between the first end portion and the second end portion, and a right top surface segment extending between the first end portion and the second end portion, a first crown for supporting the thoracic spine, the first crown being formed on the first end portion of the base panel, extending toward the second end portion of the base panel, and dividing at least partially the left top surface segment from the right top surface segment, and a transition ramp formed in the first end portion of the first crown for supporting the spine just under and below the shoulder blades of a reclining person. Other embodiments of the invention include a cylindrical pillow having a transition ramp, a removable pillow apparatus for supporting the neck of a person sitting in a bucket seat of a car, and a chair having a pillow having a substantially semi-cylindrical shape with a center axis that extends between its upper end portion and its lower end portion.

U.S. Pat. No. 5,551,752 teaches a cushion for supporting the lumbar area of the back of a person while seated in a chair. The cushion is suitable for use with different types of chairs and is comprised of an elongated strip of flexible material that drapes over the chair back and has a weight on one end thereof to allow easy adjustment of the cushion and a pad of foamed cushion material at the other end. The pad of foamed cushion material is adapted to fit between the chair back and the lumbar area of the back of the seated person and is preferably made of a heat sensitive plastic foam that will mold itself to conform to the shape of the lumbar area of the user's back from the body heat of the person seated in the chair.

U.S. Pat. No. 5,389,064 teaches an orthopedic cushion for supporting the back when sitting comprising a cushion assembly and a rear support is disclosed. The cushion assembly has a front outer surface and a stiffening backbone that is essentially curved in cross section in a plane perpendicular to the front outer surface. The backbone is also provided with spaced zones. The rear support has an upper portion and a lower portion and is foldable about a zone interposed between the upper and lower portions. Means is provided for removably connecting the upper and lower portions to the spaced zones of the backbone.

U.S. Pat. No. 4,876,755 teaches a total back support cushion device including two or three cushion devices of a semi-cylindrical shape, having been cut lengthwise through a central axis of a cylinder, with Velcro strips positioned to allow the cushions to be fastened together to form a cylindrical shape, a "T" shape for lumbar and thoracic support or cervical and thoracic support or a side lying "H" shape for support of the lumbar, thoracic and cervical regions of the back at the same time, the device being attached to a chair back for support when the person is sitting upright or the individual semi-cylindrical cushions detached and placed under the cervical or lumbar regions of the back while the person is reclining.

U.S. Pat. No. 4,835,801 teaches a back support cushion which provides neurosensory proprioceptive kinesthetics cues to the thoracic region of the spine in proximity to the apex of the thoracic curve of the spine and provides support in the vertical plane. The kinesthetic cues and vertical plane support is accomplished by shaping the face of a back cushion in such a manner that a relatively firm raised mound is formed in proximity to the area of the apex of the thoracic spine. Thus, when the person is seated, the firm raised mound provides a light pressure on the area of the thoracic spine's bony and soft tissue elements—which stimulates the neurosensory end organs located in the muscles, tendons, ligaments, joint capsules and periosteum of the thoracic spin.

U.S. Pat. No. 4,718,724 teaches an adjustable lumbar support for attachment to car and other types of seat backs including a vertically adjustable concealed lumbar support cushion.

U.S. Pat. No. 4,516,568 teaches a pressure exerting device comprising a resilient wedge shaped member and modified U-shape air bladder which may be filled to selected air pressure exerts pressure to a pre-selected pressure in a uniform manner over selected lumbar and sacroiliac areas of the body.

U.S. Pat. No. 4,471,993 teaches a device with a semi-rigid structural support orthopedically contoured in concavo-convex shape formed on a mold the exact outline of the lumbar area of ones back. The support is covered with resilient material front and back and in the convex area. A fabric cover encloses the device and includes a zipper for convenience of closure. Reversible straps fastened to the cover provide attachment to chairs or seats to assure alignment with the back and maintain integrity of the device.

U.S. Pat. No. 4,132,228 teaches a comfort support seat cushion assembly to alleviate discomfort of people that are required to sit for long terms. This comfort support seat cushion provides even pressure distribution on the gluteal region with pressure relief for the ischial tuberosities, coccyx, and perineum. A pulsating means can also be provided to administer therapeutic relief to assist in alleviating discomfort for long term sedentary positions.

U.S. Pat. No. 4,108,492 teaches a back support having a plurality of individually inflatable cushions extending horizontally across a frame and arranged such that air pressure may be adjusted in individual cushions to provide selective localized support to different areas of the back. A cross brace extends between spaced end frame members to furnish a firm support for each of the individually inflatable cushions to prevent undue deformation of the cushions, U.S. Pat. No. 3,348,880 teaches adjustable back support cushions.

US Patent Application 20060255646 teaches a body support cushion including a first section of the cushion for forming a portion of the surface of the cushion, adapted to shift from a flattened state to a flexed state and a second section of the cushion for forming another portion of the surface of the cushion, adapted to shift from a flattened state to a flexed state. A hinge couples adjoining edges of the first and second sections. A first coupling member on the first section is selectively, releasably coupled to a second coupling member on the second section to create a body support cushion in which the first and second sections are flexed which results in a body support cushion capable of moving from a flattened state to a flexed state. The body support cushion is particularly suitable for supporting a user's lower back when sitting in a chair. It is also suitable for supporting other body parts such as the knee, ankle or even the back when laying down. It can also be used to support a laptop computer or other object on one's legs or lap when sitting.

US Patent Application 20050028284 teaches a cushion object designed to provide support and comfort for the head, neck, back, legs, etc. It can be used individually while sitting up or lying down. It is made of any materials suitable for making cushioned objects. Its form and size varies depending on its use, but the characteristics are the same. 1) Head and Neck Support Cushion (Lying Down) From a vertical view, the Head and Neck Support Cushion curves into the middle with even depth curves making a narrow center. From the horizontal viewpoint, the narrow center becomes wider as it expands to the sides forming the body. The streamlines curve in or out forming a crest moon facing in or out at each end. The cushion object has built-in pockets filled with pellets (or any bead type material) or fibers. The cushion object can have single or multiple pellet pockets on one side and single or multiple fiber pockets on the other side. 2) Head and Neck Support Cushion (Sitting Up) From a vertical view, the cushion object curves into the middle with one curve deeper than the other making a narrow center. The deeper curve goes up and around the center and then goes down making the space that holds the neck in place. As in cushion number one, the narrow center becomes wider as it expands to the sides forming the body. The streamlines curve in or out forming a crest moon facing in or out at each end. The cushion has built-in pockets filled with pellets (or any bead type material) or fiber for extra support and comfort. The cushion object can have single or multiple pellet pockets on one side and single or multiple fiber pockets.

None of the prior art teaches the invention of the present application.

SUMMARY OF THE INVENTION

The invention is directed to a posture support and, more particularly, a thoracic support. The present invention is also directed to a posture training or posture correcting device that permits a user to sit with a properly aligned thoracic region of the spine. The present invention provides a device that specifically provides support to the thoracic spine, i.e. the twelve vertebra that make up the thoracic region or mid back region of a user's back. In a preferred embodiment, the device of the present invention provides only support to the thoracic region of a user's spine. In an alternative embodiment, the device of the present invention may provide support to additional regions of the spine or parts thereof. The present invention also includes a means for maintaining the thoracic support on a chair, more specifically a means wherein the thoracic support of the present invention is maintained at a height proximate to a thoracic region of a user's spine. The support of the present invention provides a construction to properly align the thoracic support with the user's thoracic spine area while sitting in a chair. The basic difference between the present invention and other back supports is that it provides significant support to the thoracic region of a user's back. As a result, the present invention treats the "cause" of many types of back pain (the cause being bad posture), while other conventional back supports, which are primarily lumbar supports do not provide the support to the thoracic region that the present invention does. The prior art supports typically treat only the "symptom" (that is: the lower back pain associated with bad posture). The bottom line is that the pain will continue as long as the bad posture is not corrected.

The spinal column has twenty-four movable vertebrae separated by twenty-three enter-vertebral disks and divided into three distinct curves, the cervical, thoracic and lumber curves. There are seven cervical vertebrae, 12 thoracic vertebrae and 5 lumbar vertebrae. The "S" shape design of these three curves enable the spine to support more weight than if it were straight.

When most people are sitting in an ordinary chair particularly at work place there is a tendency to lean forward in order to reach the computer terminal when a user leans forward the natural "S" shaped posture is replaced by a "C" shaped posture as the arms and head lean forward at a desk or table to write or to reach a keyboard and view a computer monitor.

The present invention and in particular the alternate embodiment of the present invention supports at least the thoracic curve of the spine and may, if desired, support both the thoracic and lumber curves of the spine while at the same time prevents slumping. The support of this invention restores the spine to proper S-shaped alignment and brings the user closer to a keyboard and monitor or other activity by the person sitting.

The posture support of the present invention is preferably an inflatable device. It will be appreciated, however, that a foam or other soft flexible material can be used provided it supplies firm support to the thoracic region of a user's back when the user's back is positioned against the device thereby positioning the spine in its natural "S" shape. The device is preferably made from a thermoplastic material such as polyvinyl chloride or other thermoplastic polymeric material. The support is preferably inflated to a degree so that the support may undergo some compression when the force of the user's back is placed on it. In one embodiment, as a compressive force of the back is placed on the support of the present invention at least the area of the center longitudinal axis of the posture support extends outwardly or is firmed up to conform to the thoracic region of the spine. The force of compression by the user's back causes the compressed fluid in the device to provide support to the actual thoracic region of the back. If desired, the support can also provide support to an area on either side of the thoracic region extending from the center of the spine toward one or both sides of the user. The presence of the fluid, such as air, in the support prevents the device from being completely compressed where the inner surface of the front wall of the support contacts the inner wall of the rear wall of the support.

The support of the present invention has a front surface and a rear surface. The front and rear surfaces are joined by a circumferential side wall extending from the edges of the front surface to the corresponding edges of the rear wall. The support of the present invention has a curved upper sidewall that extends from one side edge of the front and rear walls to the opposite side edge of the front and rear walls. There is a waist portion that is shorter in distance from one side wall to the opposite side wall than the distance from one side wall of the curved upper portion to the opposite side wall of the curved upper portion. The waist portion of the support of the present invention is also shorter in distance than the width of the base portion from one side wall to the opposite side wall.

The back surface of the support of the present invention is generally flat. The distance from the back surface to the front surface is greater in the upper portion of the support than in the lower portion of the support, i.e. the area closer to the base side edge. The front surface of the support may be defined as the surface that the user's back contacts. The rear surface is the surface of the support that contacts, for example, a chair or other support surface.

The distance from the rear surface to the front surface is less in the region of the base portion of the support. The distance from the rear surface to the front surface gradually lengthens or increases until the center point of the arc formed by the upper side wall of the support is reached. From the center point of the arc that forms the side wall of the support to the edges of the side wall of the arc formed by the upper side wall, the distance lessens but does not become as short as the distance from the front surface to the rear surface of the support in the region of the bottom portion.

OBJECTS OF THE INVENTION

It is an object of this invention to promote good posture by training the user to sit so the thoracic region of the spine is properly aligned.

It is an object of the invention to prevent excessive back slumping by the user.

It is an object of the invention that the support be inflatable to allow adjustments in size and support firmness.

It is an object of the invention that the support be inflated so that when compressive pressure is placed on the support by the user's back, the air in the support causes the thoracic region of the back to be supported as well.

It is an object of the invention to be adjustable to fit different users.

It is an object of the invention to be positioned between the back of a user and the back of a chair so that the thoracic region of the back is supported.

It is an object of the invention to be secured to a chair to prevent movement of the device while in use.

It is an object of the invention to provide stabilization through a relatively large contact area between the invention and the chair seat.

It is an object of the invention to be a unitary device. It is an object of the invention to be a multiple piece device.

DESCRIPTION OF THE PREFERRED EMBODIMENTS

The preferred embodiments of the present invention will now be described with reference to the drawings.

Figure 1:
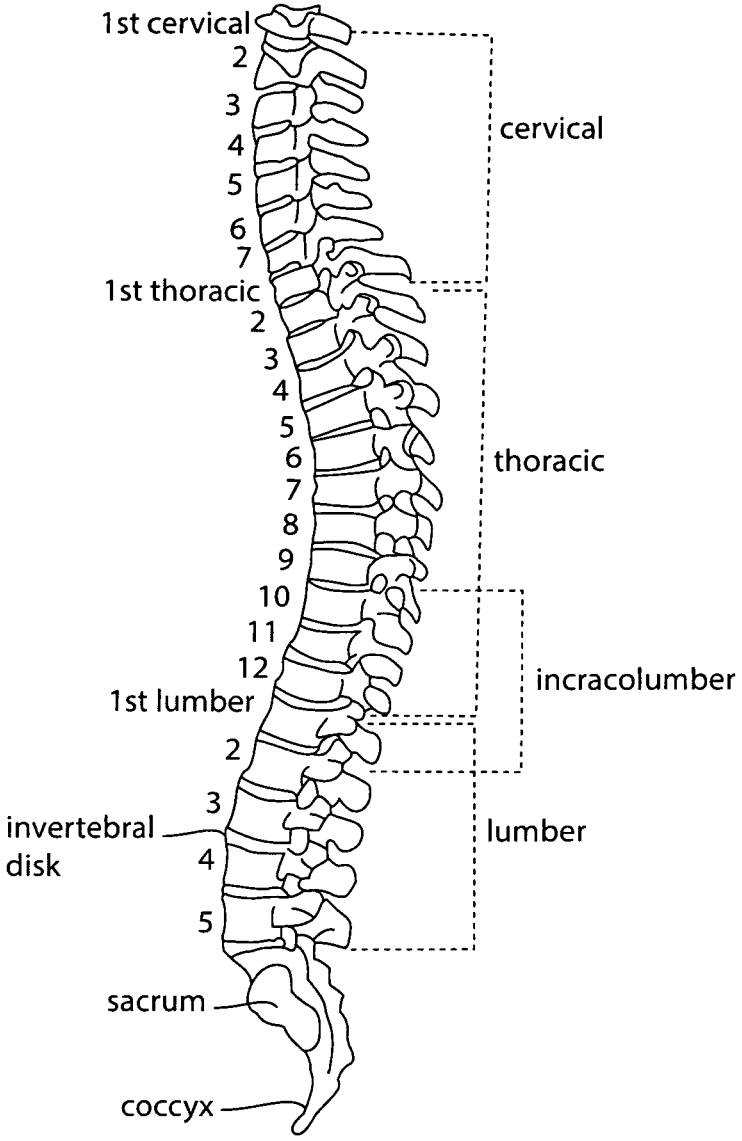
FIG. 1 is a representative example of the human spine.

FIG. 1 shows a representation of a human spine with the three curves, the cervical vertebrae, the thoracic vertebrae and the lumbar vertebrae. The particular shape of the present invention focuses pressure onto the spine. FIG. 1 shows a representative example of a human spine. There are various areas on the spine where the curve of the spine changes. For example, the region between Th12 and L1. Another region where the curvature of the spine changes is between C7 and Th1. These are weak spots where support is desired.

The shape of the support of the present invention focuses pressure onto the spine in the regions between the curvature changes. More specifically, the present invention provides support between Th1 and Th12.

The curves formed by the cervical region, the thoracic region and the lumbar region are generally in the shape of an "S". The posture trainer of the present invention provides support to a user so that the proper natural "S" shape of the spine can be achieved when the user is seated with the trainer of the present invention in position between the user's back and the back of a chair or other support.

Figure 2:
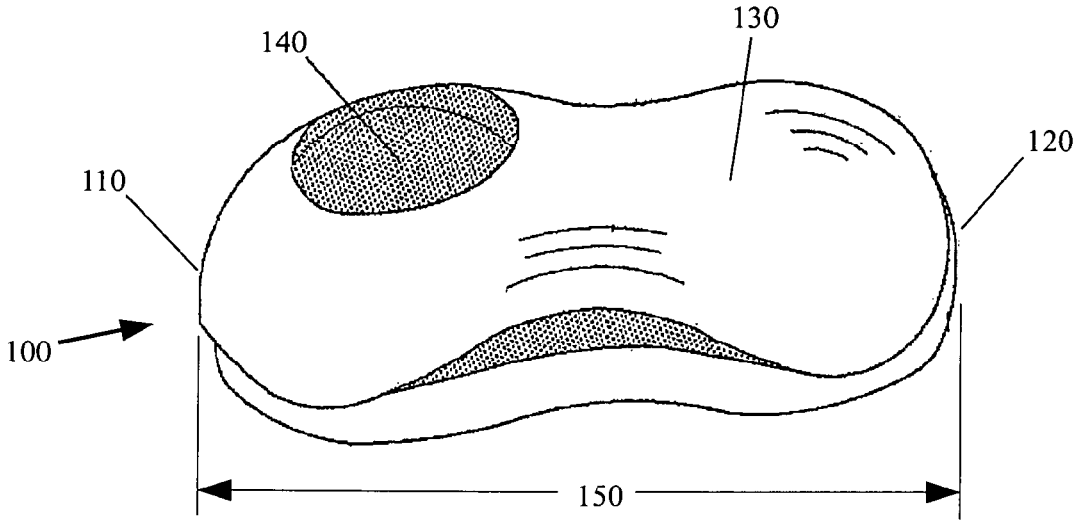
FIG. 2 is a side elevated perspective view of a preferred embodiment of the article of manufacture 100.

FIG. 2 shows a preferred embodiment of the back support 100 in an elevated side view. The article of manufacture 100 is shown with first end portion 110, second end portion 120, first support section 130, thoracic support region 140, and length 150. The support section 130 and thoracic support 140 are shown as preferably unitary, which means that the support section 130 and thoracic support section 140 are preferably manufactured as a single unit. The support section 130 and thoracic support 140 may be also be manufactured as two separate pieces that are joined together by any means, including but not limited to, using hook and loop fasteners, tape or other adhesive, snaps, gluing, heat fusing, strapping or tying them together, sewing, pinning, riveting, adhering with chemicals, or any other means. The thoracic support 140 is shown with a raised portion that may be semi-spherical and disposed near the first end 110. Although the thoracic support 140 is shown as a semi-spherical shape, it may be any shape, including but not limited to, a cube or partial cube, a three dimensional rectangular shape, or any shape that serves the purpose of the invention.

Figure 3:
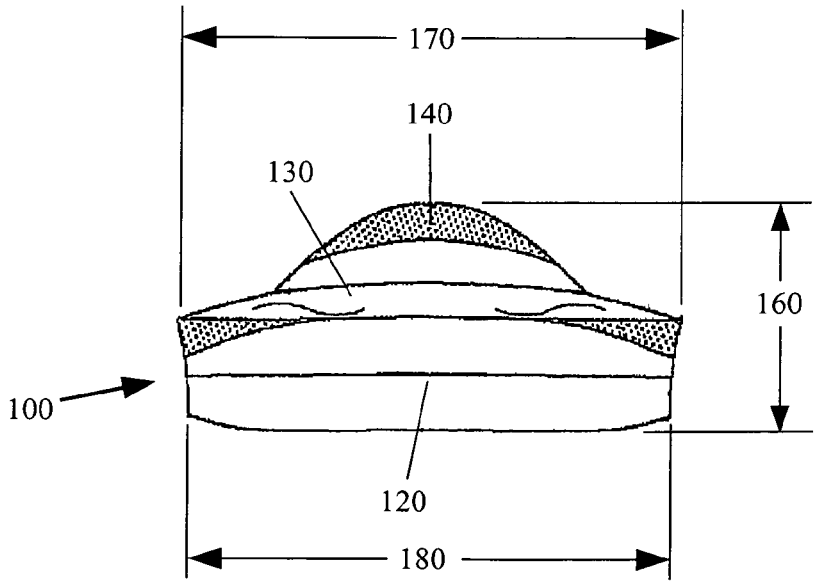
FIG. 3 is an end view of a preferred embodiment of the article of manufacture 100 as seen from the second end 120.

FIG. 3 shows a preferred embodiment of the back support 100 as seen from the second end 120. The back support 100 is shown with second end 120, support section 130, thoracic support 140, and a maximum thickness 160 in the area of the thoracic support. The support section 130 and thoracic support section 140 are shown as unitary, which means that the support section 130 and thoracic support section 140 are manufactured as a single unit. The thoracic support 140 is shown with a portion that is semi-spherical. The second end 120 is shown with second end width 180 and the thoracic support 140 is shown with thoracic support width 170. The thoracic support width 170 is shown as about the same as the second end width 180.

The back support of the present invention is preferably inflatable. When inflated, as noted above, the thoracic support region has a height that is greater than the height of the remainder of the support. More specifically, the back support of the present invention has a front surface and a rear surface. The back surface is the side of the back support that contacts a chair, for example. The front surface contacts a user's back. The rear surface is generally a flat surface in a preferred embodiment. The distance 160 from the rear surface to the front surface is greatest in the area of the thoracic support section 140. For the remainder of the back support, the distance from the rear surface to the front surface is less than the distance 160 from the rear surface to the front surface in the region of the thoracic support section 140.

Figure 4:
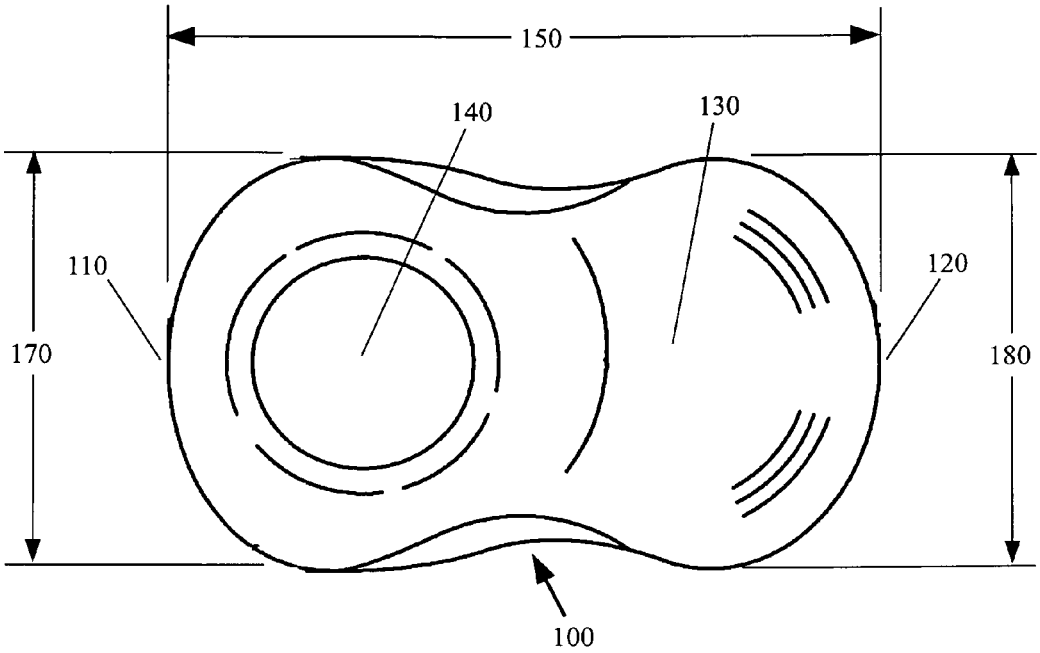
FIG. 4 is a top view of a preferred embodiment of the article of manufacture 100.

FIG. 4 shows a preferred embodiment of the back support 100 in a top view. The back support 100 is shown with first end 110, second end 120, support section 130, thoracic support section 140 and length 150. The support section 130 and thoracic support section 140 are shown as unitary, which means that the support section 130 and thoracic support section 140 are manufactured as a single unit. The thoracic support section 140 is shown with a portion that is semi-spherical and disposed on the first end 110. The second end 120 is shown with second width 180 and the thoracic support section 140 is shown with thoracic support width 170. The thoracic support width 170 is shown as about the same as the second end width 180. Although the second end 120 is shown as rounded at the bottom, it may be any shape, including but not limited to, square, horse-shoe (where the ends may extend below the chair, perhaps with fasteners beneath the chair seat), or any other shape. It may also have means for maintaining adherence to a chair seat, such as but not limited to, straps, ties, hook and loop fasteners, tape or other adhesive, snaps, rivets, or any other means. Alternatively, the second end 120 could be weighted to keep it in place.

Figure 5:
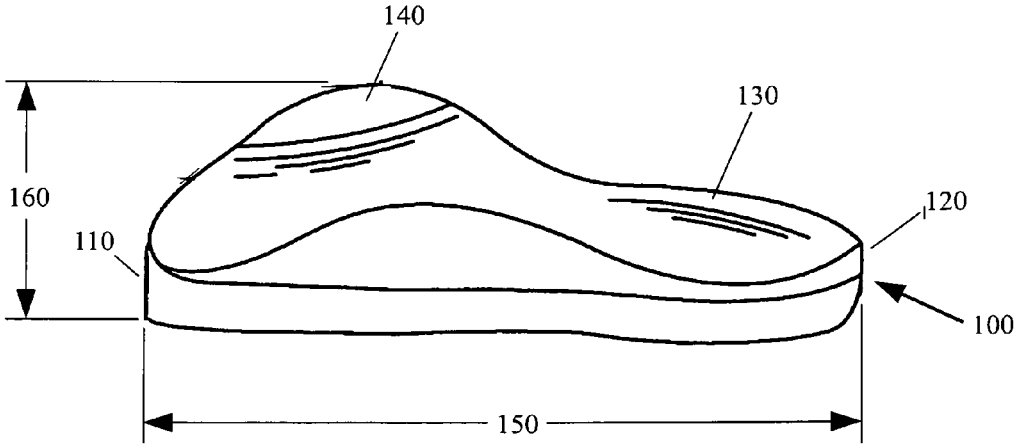
FIG. 5 is a side view of a preferred embodiment of the article of manufacture 100.

FIG. 5 shows a preferred embodiment of the back support 100 in a side view. The back support 100 is shown with first end 110, second end 120, support section 130, thoracic support section 140, length 150 and thickness 160. The support section 130 and thoracic support section 140 are shown as unitary, which means that the support section 130 and thoracic support section 140 are manufactured as a single unit. The thoracic support 140 is shown with a portion that is semi-spherical and disposed on the first end 110. As can be seen in FIG. 4, the first end 110 of the back support 100 is raised in relation to the second end 120, with the thoracic support section 140 adding more height. This shape conforms to the user's back. In a preferred embodiment, the thoracic support section 140 is inflatable, allowing the invention to be tailored to the user's body for maximum effectiveness.

The thoracic support section 140 keeps the upper back from resting on the back of the chair, thus working with the support section 130 to maintain proper posture. In the case of lower back supports described in the prior art, the upper back may rest upon the chair while the lower back is held away from the chair back, thus allowing the body to get out of alignment.

Figure 6:
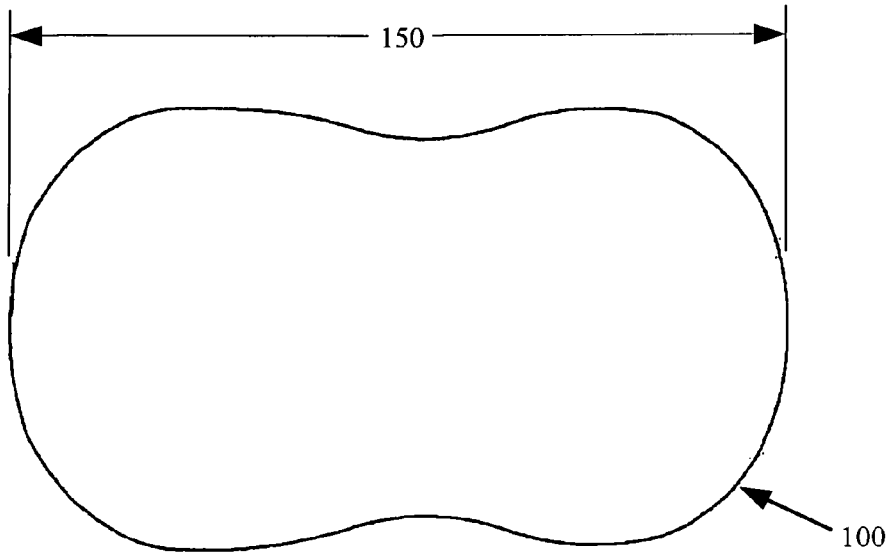
FIG. 6 is a bottom view of a preferred embodiment of the article of manufacture 100.

FIG. 6 shows a preferred embodiment of the back support 100 in a bottom view. The back support 100 is shown with support section 130, and length 150.

Figure 7:
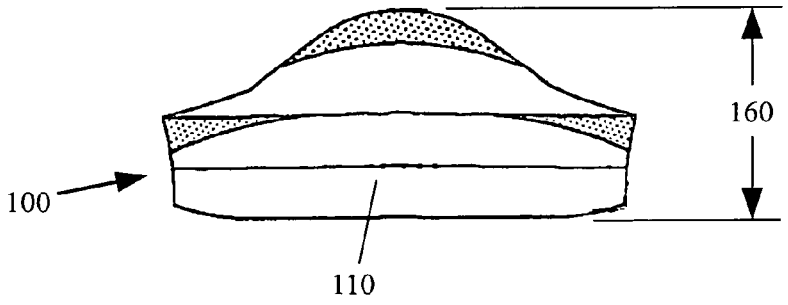
FIG. 7 is an end view of a preferred embodiment of the article of manufacture 100 as seen from the first end 110.

FIG. 7 shows a preferred embodiment of the back support 100 in an end view as seen from the first end 110. The article of manufacture 100 is shown with first end 110, support section 130 and thickness 160. The support section 130 and thoracic support section 140 are shown as unitary, which means that the support section 130 and thoracic support section 140 are manufactured as a single unit. The thoracic support section 140 is shown with a portion that is semi-spherical and disposed on the first end 110.

Figure 8:
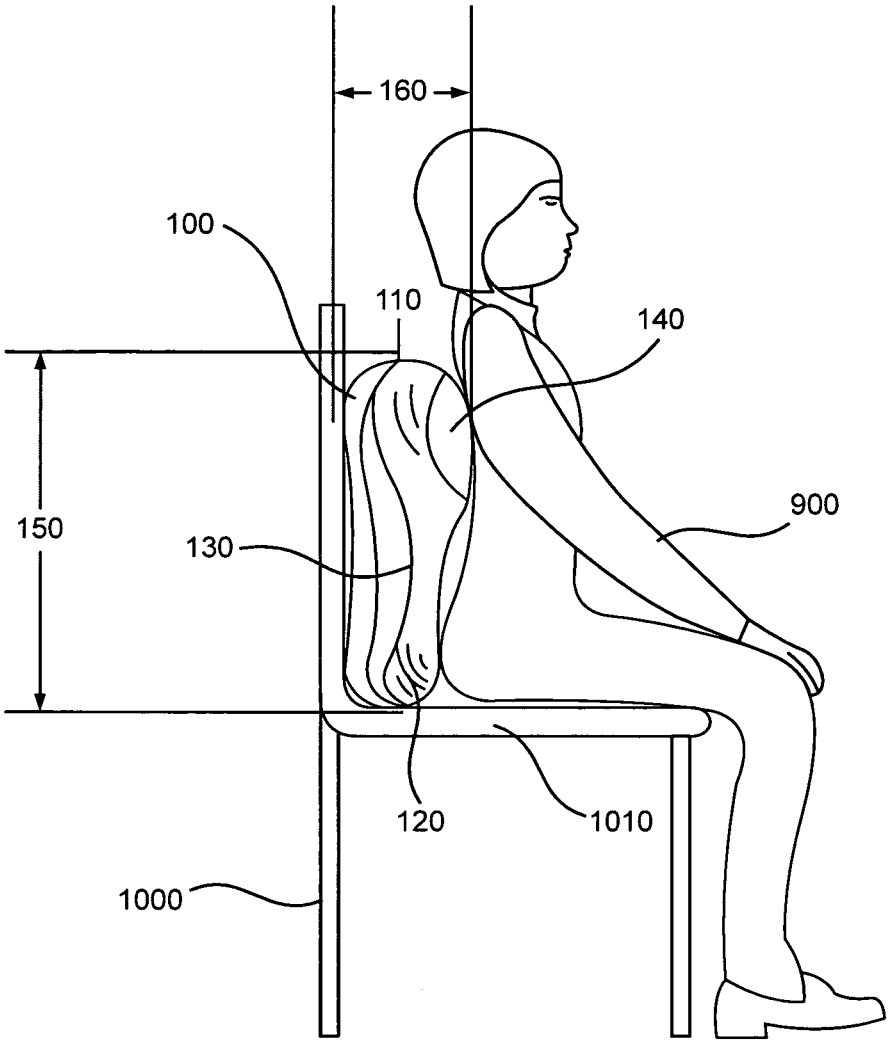
FIG. 8 is a side view of a preferred embodiment of the article of manufacture 100 in use.

FIG. 8 shows a preferred embodiment of the back support 100 being used and thus promoting proper back alignment. A chair 1000 is shown with a chair seat 1010 with a user 900 sitting in the chair 1000. The resulting position also promotes a head straight-up position and eyes-forward position. The back support 100 is shown with first end 110, second end 120, support section 130, thoracic support section 140, length 150, a thickness 160. The support section 130 and thoracic support section 140 are shown as unitary, which means that the support section 130 and thoracic support section 140 are manufactured as a single unit. The thoracic support section 140 is shown with a portion that is semi-spherical and disposed on the first end 110. The second end 120 is shown supported by the chair seat 1010. The support section 130 is shown maintaining the thoracic support section 140 at a height proximate to a thoracic region of a user's spine.

As seen in FIG. 7, the general arrangement of the back support of the present invention is shown in position with a user before the user places pressure on the back support of the present invention. As the user pushes back against the back support, the fluid in the back support is compressed on either side of the spine causing the fluid in the support adjacent to the thoracic region of the spine to support the thoracic region of the back, namely the twelve thoracic vertebrae. As the thoracic vertebrae push against the back support 100, the fluid in the support provides the center region i.e. thoracic region of the back with support and helps improve posture because it helps the spine conform to its natural "S" shaped curve.

The design of the present invention provides a unique airflow system, which is created as a result of the convex circular shaped bubble that lies at the top portion of the back support. This feature allows the fluid in the thoracic region of the back support to form a firm surface once it meets with the thoracic region of the user's spine. The pressure that is created when the back support meets with the thoracic region of the user's spine compresses the back support, which in turn forces the fluid downward into the lumbar region as well. The term "fluid" refers to any suitable gas or liquid. This process allows the present invention to mold perfectly to the contour of the users "entire back," creating an orthotic effect that supports proper spinal alignment, consequently relieving the user's pain and discomfort.

This differs significantly from most back supports where only the lumber region is supported by most conventional back supports. Therefore, the present invention not only treats the symptoms, but the cause as well by supporting both the thoracic and lumbar spine and in the process eliminates slouching, the leading cause of back pain as defined by the Mayo Clinic, due to the loss of stability and support. Other conventional support devices such as a pillow do not hold their shape or provide adequate support and stability when pressure from the back is present. While the surface of the pillow superficially may conform to the user's back there is no outward pressure against the spine's thoracic region when the lumbar and cervical regions of the back press up against the pillow. In addition, the pressure that is created by a pillow creates lateral or side-to-side pressure, not pressure against the back. The hollow, fluid-filled case of the present invention is advantageous as the user moves around in the chair, because as the user shifts his position to the left or right, the present invention continues to provide gentle, yet firm support to the thoracic and lumbar regions of the back.

Other conventional materials, such as a "Temperpedic" type foam also do not provide the same type of support as the present invention. A foam material also does not provide the same type of support as the present invention. When a foam material receives pressure from the back, whether the pressure is received from the cervical region of the back, the thoracic region or the lumbar region, the force compressing these regions does not cause the area of the support adjacent the compressed region to expand toward the user's back. Thus, in a foam support the compressed support does not "push back" against the back like the inflated support of the present invention contacting, for example, the thoracic region and providing support for that region.

Many vehicles provide lumbar support whereby only the lumbar region of the back is provided with support. The present invention is not typically used in a vehicle application as there is a risk that the user would sit too far forward in the car's seat and be too close to the air bag when an air bag is activated in an accident, for example. If the user is in too close proximity to the air bag, injury could be caused due to the force of the air bag suddenly inflating.

Although the back support of the present invention is shown resting on the seat portion of the chair, it does not have to. The present invention also works when the back support of the present invention is position so there is contact between at least a portion of the thoracic region. In an alternative embodiment, there can be contact between the support and one or both of the lumbar region and the cervical region as well as the thoracic region.

In one preferred embodiment the invention of the present application is an back support 100 that improves posture and relieves back pain. The back support of the present invention comprises: a thoracic support section 140; and means for maintaining the thoracic support on a chair 1000. The thoracic support section 140 may be constructed from a wide variety of materials including but not limited to: plastic, fabric, glass-based materials, animal skin, composites, rubber, foam rubber, other foam materials, metals, wood and wood-based materials, or combinations of these or other materials. The thoracic support section 140 may be inflatable. A means for maintaining the back support may include but not be limited to, a strap which secures the thoracic support section 140 to a chair 1000, ties, hook and loop fasteners, tape or other adhesive, snaps, rivets, or any other means. The securing means may be anywhere on the back support 100, and there may be any number of securing devices.

An alternative means of maintaining the thoracic support may be a support section 130 having a first end 110 and a second end 120 with the thoracic support section 140 disposed on the first end 110 and the second end 120 supported by a chair seat 1010. The thoracic support section 140 may have a portion that extends outwardly and may, for example, be semi-spherical. The support section 130 and the thoracic support section 140 may be unitary, which means that the support section 130 and thoracic support section 140 are manufactured as a single unit. The support section 130 may be constructed from a wide variety of materials including but not limited to: fabric, glass-based materials, animal skin, composites, rubber, foam rubber, other foam materials, metals, wood and wood-based materials, or combinations of these or other materials. The thoracic support section 140 may have a thoracic support width 170 and the second end 120 may have a second end width 180 and the thoracic support width 170 may be about the same as the second end width 180. The thoracic support section 140 may have a thickness 160 of between 1.5 and 6 inches. This preferred embodiment of the invention may have a length 150 of between 15 and 21 inches, and a width 170 of from 10 to 13 inches. In an another preferred embodiment the invention of the present application is a back support, comprising: an inflatable thoracic support; and means for maintaining the thoracic support on a chair 100; wherein the thoracic support section 140 is maintained at a height proximate to the thoracic region of a user's spine. The thoracic support section 140 may be constructed from a wide variety of materials including but not limited to: fabric, glass-based materials, animal skin, composites, rubber, foam rubber, other foam materials, metals, wood and wood-based materials, or combinations of these or other materials. A means for maintaining the back support may any means, including but not limited to, a strap which secures the thoracic support section 140 to a chair 1000, ties, hook and loop fasteners, tape or other adhesive, snaps, rivets, or any other means. An alternative means of maintaining the thoracic support is a support section 130 having a first end 110 and a second end 120 with the thoracic support section 140 disposed on the first end 110 and the second end 120 supported by a chair seat 1010. The thoracic support section 140 may have a portion that is semi-spherical. The support section 130 and the thoracic support section 140 may be unitary, which means that the support section 130 and thoracic support section 140 are manufactured as a single unit. The support section 130 may be constructed from a wide variety of materials including but not limited to: fabric, glass-based materials, animal skin, composites, rubber, foam rubber, other foam materials, metals, wood and wood-based materials, or combinations of these or other materials. The thoracic support section 140 may have a thoracic support width 170 and the second end 120 may have a second end width 180 and the thoracic support width 170 may be about the same as the second end width 180. The thoracic support section 140 may have a thickness 160 of between 1.5 and 6 inches. This preferred embodiment of the invention may have a length 150 of between 15 and 21 inches, and a width 170 of from 10 to 13 inches.

In an alternative embodiment, the article of the present invention preferably has an outer flexible casing or cover and contains, at least in a portion of the interior of the article, a fluid such as a liquid, gas or gel. Preferably, the fluid is a gas such as air to keep this device lighter and easier to carry. The presence of a fluid in the article enables the support to conform to at least a portion of the user's back. The support is preferably hollow in its interior, although it will be appreciated that it does not have to be entirely hollow. Preferably, a major portion of the interior of the support is hollow. By a major portion is meant at least 50% of the interior of the support is hollow. More preferably, at least 75% of the support is hollow. Most preferably, at least 90% of the support is hollow.

Figure 11:
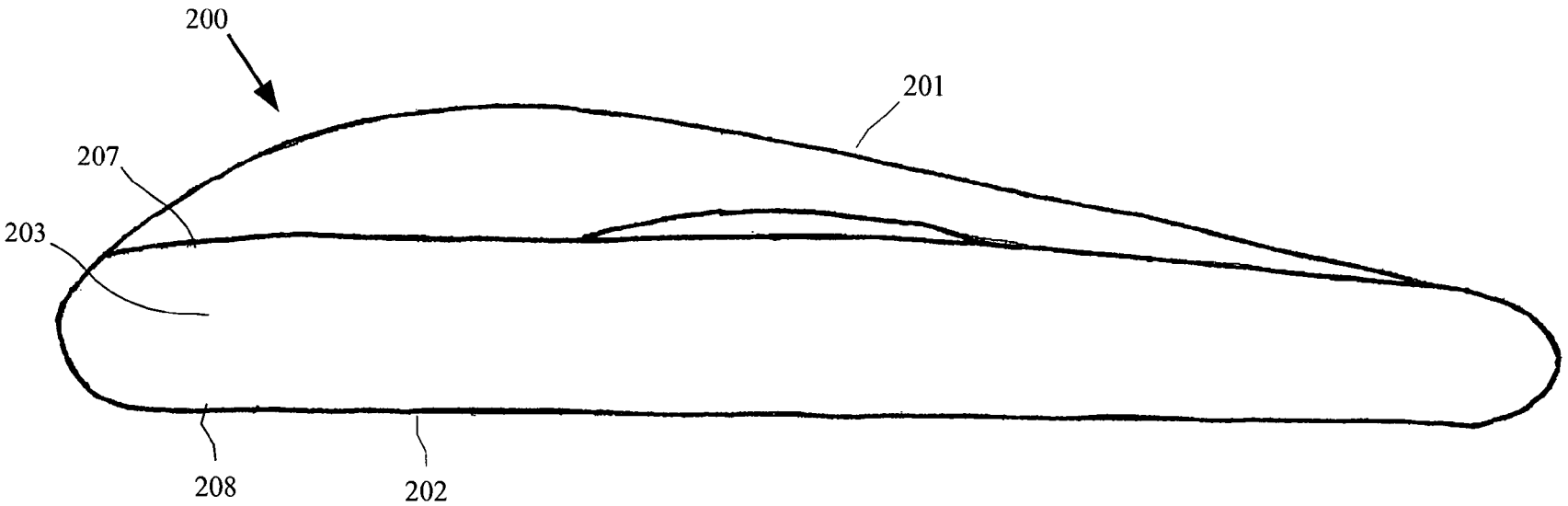
FIG. 11 is a side view of the support of FIG. 9.

As seen in FIG. 11, the posture support 200 of this embodiment has front contact surface 201 that contacts a user's back and a rear contact surface 202 which contacts a chair back or other support surface. The support 200 is preferably made from a flexible thermoplastic material such as polyvinyl chloride. The rear surface 202 of back support is generally flat but may bulge outwardly slightly depending on the quality and quantity of the fluid such as air contained in the support. The preferred amount of fluid is sufficient to have the flexible support maintain the shape but not so much air that pressure on the support would prevent it from conforming the back contact surface of the support to the user's back.

Figure 9:
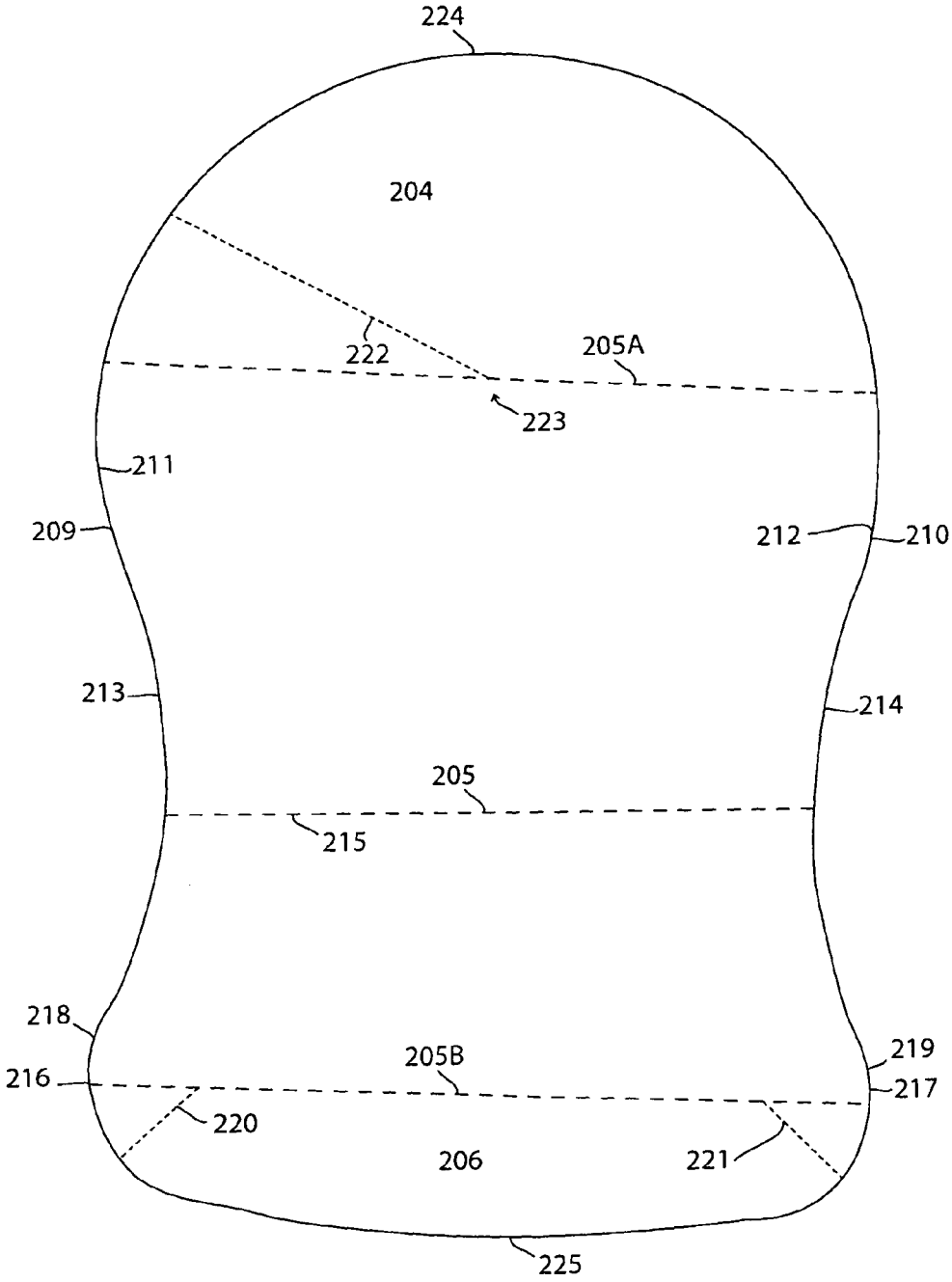
FIG. 9 is a top view of an alternative embodiment of the support of the present invention.
Figure 10:
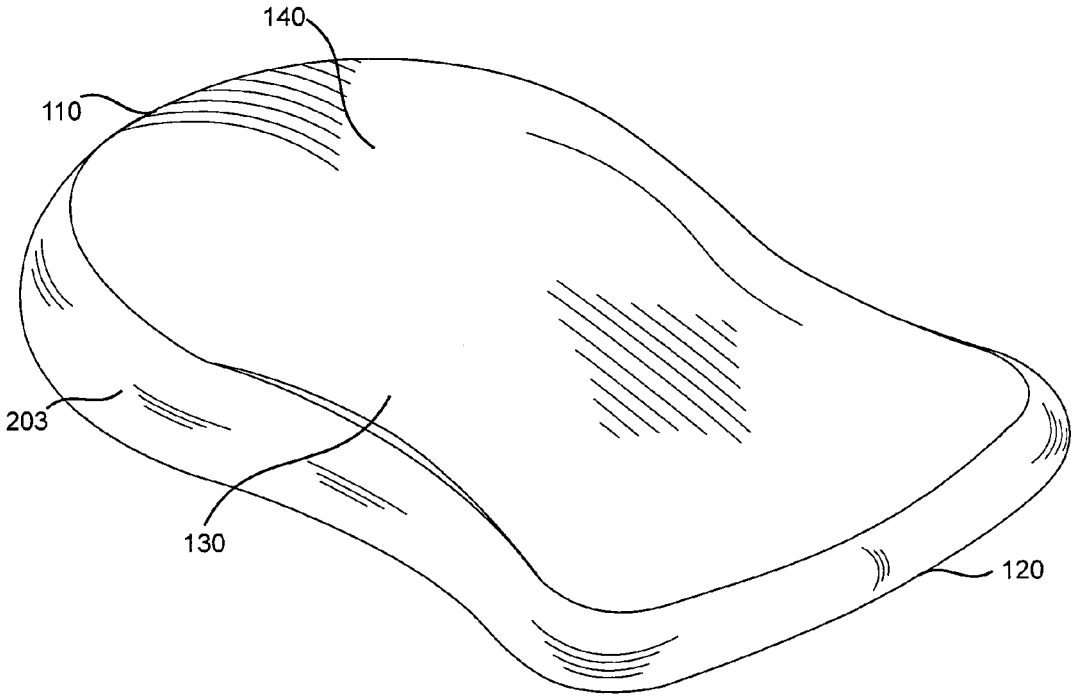
FIG. 10 is a perspective view of the support of FIG. 9.

As seen in FIG. 9, the top surface 201 of the support, as well as the support itself preferably has three sections. There is a top portion 204, a waist portion 205, and a bottom portion 206.

The top surface or back contact surface 201 and the support contact surface 202 are joined by a sidewall 203. The sidewall may have any suitable shape but preferably has a cross section that is generally a curve, preferably a curve that is the arc of a circle. The arc extends from one edge 207 of the back support surface to the opposing edge 208 of the support contact surface.

The back support of the present embodiment has a generally hour glass shape. As noted above, there is a top portion 204. The top portion 204 is generally a circular portion of an arc extending from a point 209 on one side of the support to a point 210 on the opposite side of the support. Preferably the arc is at least a semicircle equal to or greater than 180° of the circle. Where the arc is greater than 180°, the circumferential or perimeter edges of the sidewall at point 211 and point 212 start to curve towards each other. There is a waist portion 205 that has a side wall portion 213 and 214 on each side edge of the back support. The side wall portions 213 and 214 are generally concave. The waist portion has a width 215 from the center of said concave portion on one side of the top surface 201 to the center of said concave portion on the opposite side of the top surface 201. The length 215 of the waist portion is less than the corresponding width 205A and 205B of the top portion and the bottom portion, respectively. There is a base or bottom portion 206 that includes a pair of "wings" 216 and 217 at each side of the base. These wings have a generally convex shape and are connected to the concave edge of the waist portion at points 218 and 219. The curve of the wings 216 and 217 may have a generally significantly shorter radius 220 and 221 of the arc forming the curve than the corresponding radius 222 of the top section of the back support or the curve of the the concave portions of the waist portion 205.

The center point 223 of the arc extending from points on the circumference 211 to 212 is along the center axis of the back support. Opposite sides of the axis formed by an imaginary axis line extending from the uppermost point 224 to the base or lowermost point 225 of the support are preferably mirror images of each other. Similarly, points 211 and 212 that form the junction where the convex type curve of the side wall of the top portion meets the concave type curve of the side wall at the waist portion are opposite each other on the support. Also opposite each other are points 218 and 219. These are the points where the convex curve of the wings meet the concave curve of the waist portion.

The thickness of the back support of the present invention from the rear support surface to the said front/back contact surface varies across the length of the back support of this embodiment. The thickness is preferably greater in the region of the top section and gradually decreases towards the base 225. Similarly the thickness of the center axis from the top edge to the base or bottom edge is thicker than the parallel axes that are closer to the sidewalls. As the parallel axes get closer to the respective sidewalls the thickness of the support decreases.

The center point 223 of the arc of the top section 204 is preferably the thickness point on the top surface of the back support. The thickness decreases as one moves from the center point to the circumference of the arc formed by the line from 211 to 212. Similarly, the thickness of the back support decreases as one moves from the center point to the bottom edge 225, as well as toward the points 218 and 219.

Although this invention has been described with a certain degree of particularity, it is to be understood that the present disclosure has been made only by way of illustration and that numerous changes in the details of construction and arrangement of parts may be resorted to without departing from the spirit and the scope of the invention.

I claim:

1. A posture trainer, comprising:

a body with a front surface and a back surface, a first end and a second end, and a side wall that extends around the trainer to form a cavity configured to retain a fluid therein to thereby inflate said body, said front surface configured to selectively contact a back of a user, said body comprising:

a bottom portion, said bottom portion comprising a first thickness between said back surface and said front surface;

a top portion, said top portion comprising an outward bulge substantially centered on said front surface, said top portion comprising a second thickness between a peak of said outward bulge and said back surface, said second thickness being greater than said first thickness; and wherein said selective contact comprises:

said front surface of said bottom portion configured to contact a lower back of a seated person; and said peak of said outward bulge of said front surface of said top portion positioned distal from said bottom portion to thereby be configured to initially contact and focus pressure on a portion of a thoracic spinal region of said seated person to support an upper thoracic spinal region of said seated person in a proper seated relation with the lower back, using the difference between said second thickness and said first thickness.

2. The posture trainer of claim 1 further comprising a waist portion between said top portion and said bottom portion and wherein a width of said waist portion is less than a width of said top portion, and less than a width of said bottom portion; said top portion, said waist portion, and said bottom portion thereby forming an hourglass shape.

3. The posture trainer of claim 1, further comprising a means for maintaining a trainer on the chair.

4. The posture trainer of claim 1 wherein said body comprises a flexible thermoplastic material; and wherein said selective contact further comprises said flexible thermoplastic material of said body configured to be sufficiently inflated to permit deformation of said outward bulge of said top portion.

5. The posture trainer according to claim 1 wherein said outward bulge comprises a circular-shaped bubble.

6. The posture trainer according to claim 1 wherein said top portion comprises an arc-shaped perimeter, said arc-shaped perimeter forming a portion of an arc of a circle.

7. The posture trainer according to claim 6 wherein said arc-shaped perimeter forming a portion of an arc of a circle is at least 180°.

8. A posture trainer, for use with a chair to initially focus pressure on a portion of a thoracic spinal region of a person seated therein, to properly support an upper thoracic spinal region of said person in relation to a lumbar spinal region of said person to position the spine of said person in a proper S-shaped alignment, said posture trainer comprising:

a body, said body comprising a front surface, a back surface, and a curved transition surface therebetween, a portion of said body configured to form a hollow cavity, said hollow cavity configured to retain a fluid therein to inflate a portion of said body, wherein said back surface is configured to contact the back of the chair, wherein a base of said curved transition surface is configured to be proximate to the seat of the chair, and wherein said front surface is configured to selectively contact the back of the person, said body comprising:

a bottom portion, said bottom portion comprising a first thickness between said back surface and said front surface, beginning at said base of said curved transition surface;

a top portion, said front surface at said top portion comprising a convex surface with an outward bulge substantially centered thereon, said top portion comprising a second thickness between an apex of said outward bulge and said back surface, said second thickness being greater than said first thickness; and a waist portion, said waist portion configured as a transition between said top portion and said bottom portion; and wherein said selective contact comprises:

said front surface of said bottom portion configured to contact the lower back of the seated person; and said apex of said outward bulge of said front surface of said top portion positioned distal from said base to thereby be configured to initially contact and focus pressure on a portion of the thoracic spinal region to support the upper thoracic spinal region in a proper seated relation with the lower back, using the difference between said second thickness and said first thickness.

9. The posture trainer according to claim 8, wherein said outward bulge comprises a spherical section.

10. The posture trainer according to claim 9, wherein said front surface at said top portion comprises an arc-shaped perimeter, said arc-shaped perimeter forming a portion of an arc of a circle.

11. The posture trainer according to claim 10, wherein said arc-shaped perimeter forming a portion of an arc of a circle comprises an arc of greater than 180 degrees.

12. The posture trainer according to claim 11, wherein a distance between said curved transition surface on opposite sides of said posture trainer decreases at said waist portion; said top portion, said waist portion, and said bottom portion thereby forming an hourglass shape.

13. The posture trainer according to claim 12, wherein said body comprises a flexible thermoplastic material; and wherein said selective contact further comprises said flexible thermoplastic material of said body configured to be sufficiently inflated to permit deformation of said outward bulge of said top portion.

14. The posture trainer according to claim 13, further comprising means for adhering, said means for adhering configured to adhere said posture trainer to the back of the chair to elevate said base of said posture trainer above the seat of the chair.

15. A posture trainer, for use in properly supporting a back of a person seated in a chair, said posture trainer comprising:

a body, said body having a front surface, a back surface, and a curved transition surface therebetween, a portion of said body configured to form a hollow cavity, said hollow cavity configured to retain a fluid therein to inflate a portion of said body, said front surface configured to selectively contact the back of the person, said body comprising:

a bottom portion, said bottom portion comprising a first thickness between said back surface and said front surface;

a top portion, said front surface at said top portion comprising a convex surface with an outward bulge substantially centered thereon, said top portion comprising a second thickness between an apex of said outward bulge and said back surface, said second thickness being greater than said first thickness of said bottom portion; and wherein said selective contact comprises:

said front surface of said bottom portion configured to contact the lower back of the seated person; and said apex of said outward bulge of said front surface of said top portion positioned distal from said bottom portion to thereby be configured to initially contact and focus pressure on a portion of a thoracic spinal region of said person to support an upper thoracic spinal region of said person in a proper seated relation with the lower back, using the difference between said second thickness and said first thickness.

16. The posture trainer according to claim 15, wherein said outward bulge comprises a spherical section.

17. The posture trainer according to claim 16, wherein said body comprises a flexible thermoplastic material; and wherein said selective contact further comprises said flexible thermoplastic material of said body configured to be sufficiently inflated to permit deformation of said outward spherical bulge of said top portion.

18. The posture trainer according to claim 17, wherein said front surface at said to portion comprises an arc-shaped perimeter, said arc-shaped perimeter forming a portion of an arc of a circle.

19. The posture trainer according to claim 18, wherein said arc-shaped perimeter forming a portion of an arc of a circle comprises an arc of greater than 180 degrees.

20. The posture trainer according to claim 19, wherein a distance between said curved transition surface on opposite sides of said posture trainer decreases at a waist portion of said body of said posture trainer, said waist portion configured as a transition between said top portion and said bottom portion; and wherein said top portion, said waist portion, and said bottom portion thereby form an hourglass shape.

21. The posture trainer according to claim 20, further comprising means for adhering, said means for adhering configured to adhere said posture trainer to the back of the chair.

22. The posture trainer according to claim 21, further comprising means for adjusting the degree of inflation of said body to permit adjustments to a firmness of said body.

23. A posture trainer comprising a support, said support having a back contact surface, a support contact surface and at least one side wall joining said top and bottom surfaces, said sidewall having a cross section that is the arc of a circle of said sidewall extending from one edge of the back support surface to an opposing edge of the support contact surface, said support having a hollow interior configured to contain a fluid, said support having at least three portions, a top portion, a bottom portion, and a waist portion connecting said top and bottom portions, said top portion having an outer edge connected to said sidewall, said outer edge forming a circular portion of an arc extending from a point on said edge on one side of the support adjacent a first transition portion between said top portion and said waist portion to a second point on said edge on the opposite side of the support adjacent a second transition portion between said top portion and an opposite side of said waist portion, said top portion arc being at least a semicircle equal to or greater than 180°, and wherein said transition portions have an edge that curves inwardly towards the respective opposite transition portions and said transition portions with said opposite sides of said waist portion forming a concave section on said opposite sides of said waist portion, said waist portion having a width from a center of said concave section on one side of the support to the center of said concave section on the opposite side of said support, said at least three portions forming a generally hour glass shape wherein the width of the waist portion being less than a corresponding width of the top portion and the bottom portion, respectively, and wherein said bottom portion includes a pair of wings at opposite sides of the said bottom portion extending outwardly therefrom, an outer edge of said wings having a curve that is generally convex and wherein said wings are connected to the concave section of the waist portion by third and fourth transition portions respectively, the curve of the wings having a shorter radius than the corresponding radius of the top portion of the back support and the radius curve of the concave sections of the waist portion and wherein said bottom portion comprising a first thickness between said back surface and said body contact surface and said top portion comprising an outward bulge substantially centered on said body contact surface, said top portion comprising a second thickness between a peak of said outward bulge and said back surface, said second thickness being greater than said first thickness.

* * * * *